US009423725B2

(12) United States Patent
Yamauchi

(10) Patent No.: US 9,423,725 B2
(45) Date of Patent: Aug. 23, 2016

(54) IMAGE FORMING APPARATUS

(71) Applicant: KYOCERA Document Solutions Inc., Osaka (JP)

(72) Inventor: Hironori Yamauchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/839,965

(22) Filed: Aug. 29, 2015

(65) Prior Publication Data

US 2016/0062277 A1 Mar. 3, 2016

(30) Foreign Application Priority Data

Aug. 29, 2014 (JP) ..... 2014-175551
Aug. 29, 2014 (JP) ..... 2014-175552

(51) Int. Cl.
*G03G 21/08* (2006.01)
*G03G 15/16* (2006.01)

(52) U.S. Cl.
CPC ..... *G03G 15/1605* (2013.01); *G03G 21/08* (2013.01); *G03G 2215/0132* (2013.01); *G03G 2215/0193* (2013.01)

(58) Field of Classification Search
CPC ..... G03G 21/06; G03G 21/08
See application file for complete search history.

(56) References Cited

U.S. PATENT DOCUMENTS

2013/0156451 A1* 6/2013 Hano ..... G03G 15/1695 399/49
2014/0139607 A1* 5/2014 Hayashi ..... G03G 15/04054 347/224
2015/0309450 A1* 10/2015 Saito ..... G03G 15/0136 399/128

FOREIGN PATENT DOCUMENTS

JP 2007-271873 A 10/2007

* cited by examiner

*Primary Examiner* — Gregory H Curran
(74) *Attorney, Agent, or Firm* — Hawaii Patent Services; Nathaniel K. Fedde; Kenton N. Fedde

(57) ABSTRACT

An image forming apparatus being capable of commonalizing a control signal for lighting of static eliminators, and controlling the static eliminators with a single port of CPU. The image forming apparatus includes a main body control part controlling image formation; a nip separation mechanism separating an intermediate transfer belt from color photosensitive drums; a separation control part driving nip separation mechanism on a separation control signal inputted from main body control part; a monochrome static eliminator comprised of a monochrome light guide body and a monochrome light source irradiating light on its end face; color static eliminators comprised of color light guide bodies and color light sources irradiating light on their end faces; and an irradiation location shifting mechanism shifting irradiation location of light emitted from color light source from end face of color light guide body when intermediate transfer belt is separated from color photosensitive drums.

6 Claims, 9 Drawing Sheets

IMAGE FORMING APPARATUS

INCORPORATION BY REFERENCE

This application is based on and claims the benefit of priority from Japanese Patent Application No. 2014-175551 filed on Aug. 29, 2014 and No. 2014-175552 filed on Aug. 29, 2014, the contents of which are hereby incorporated by reference.

BACKGROUND

The present disclosure relates to an electrophotographic image forming apparatus being capable of forming a single color monochrome image and a color image having a plurality of colors.

An image forming apparatus, such as a color printer, includes, for example, a plurality of photosensitive drums on which toner images of respective colors of black, yellow, magenta, and cyan are formed, and an intermediate transfer belt to which the toner images that have been formed on these plurality of photosensitive drums are transferred. With the plurality of photosensitive drums, a series of electrophotographic processes of electrification, exposure, development, and transfer are performed. The toner images of the respective colors that have been formed on the respective photosensitive drums are primary-transferred to the intermediate transfer belt, and then collectively secondary-transferred to a paper from the intermediate transfer belt. Thereby, a color image is formed on the paper.

The respective photosensitive drums are provided with a static eliminator (an eraser), which eliminates static electricity from the surface of the respective photosensitive drums by light irradiation. The static electricity elimination is performed after the transfer as a pre-treatment for electrification at the next time. Such static electricity elimination must be suppressed to a necessary minimum, because it involves light irradiation on the surface of the photosensitive drum, resulting in an optical fatigue thereof. Then, upon a monochrome image of a single color being formed, the static eliminators for the photosensitive drums of respective colors of yellow, magenta, and cyan that are used for forming a color image are controlled so as not to be lighted.

SUMMARY

The image forming apparatus of the present disclosure is an image forming apparatus including a monochrome image forming part that forms a toner image for a monochrome image on a monochrome photosensitive drum; color image forming parts that form toner images for color images on color photosensitive drums; and an intermediate transfer belt that once carries the toner image to be transferred to a recording paper, the image forming apparatus, at the time of monochrome printing, transferring only the toner image that has been formed on the monochrome photosensitive drum, to the intermediate transfer belt, and at the time of color printing, sequentially transferring the toner image that has been formed on the monochrome photosensitive drum, and the toner images that have been formed on the color photosensitive drums, to the intermediate transfer belt, the image forming apparatus having;

a main body control part that controls image formation with the monochrome image forming part and the color image forming parts, a nip separation mechanism that separates the intermediate transfer belt from the color photosensitive drums, a separation control part that drives the nip separation mechanism on the basis of a separation control signal that is inputted from the main body control part, a monochrome static eliminator that is comprised of a monochrome light guide body that extends in a rod shape along the monochrome photosensitive drum, and a monochrome light source that irradiates light on an end face of the monochrome light guide body, color static eliminators that are comprised of color light guide bodies that extend in a rod shape along the color photosensitive drums, and color light sources that irradiate light on end faces of the color light guide bodies, and an irradiation location shifting mechanism that shifts the irradiation locations of the light that is emitted from the color light sources, from the end faces of the color light guide bodies, in a state of the intermediate transfer belt being separated from the color photosensitive drums.

Further, the image forming apparatus of the present disclosure is an image forming apparatus including a monochrome image forming part that forms a toner image for a monochrome image on a monochrome photosensitive drum; color image forming parts that form toner images for color images on color photosensitive drums; and an intermediate transfer belt that once carries the toner image to be transferred to a recording paper, the image forming apparatus, at the time of monochrome printing, transferring only the toner image that has been formed on the monochrome photosensitive drum, to the intermediate transfer belt, and at the time of color printing, sequentially transferring the toner image that has been formed on the monochrome photosensitive drum, and the toner images that have been formed on the color photosensitive drums, to the intermediate transfer belt, the image forming apparatus having:

a main body control part that controls image formation with the monochrome image forming part and the color image forming parts, a nip separation mechanism that separates the intermediate transfer belt from the color photosensitive drums, a separation control part that drives the nip separation mechanism on the basis of a separation control signal that is inputted from the main body control part, a monochrome static eliminator that eliminates static electricity from the monochrome photosensitive drum, a color static eliminator that eliminates static electricity from the color photosensitive drums, a switch that is turned ON in a state of the intermediate transfer belt being abutted against the color photosensitive drums, and that is turned OFF in a state of the intermediate transfer belt being separated from the color photosensitive drums, a monochrome lighting power supply part that makes power distribution to the monochrome static eliminator to light it up on the basis of a lighting control signal that is inputted from the main body control part, and color lighting power supply parts that make power distribution to the color static eliminators to light them up on the basis of the lighting control signal that is inputted from the main body control part through the switch.

DETAILED DESCRIPTION

Next, a first embodiment of the present disclosure will be specifically explained with reference to the drawings.

Figure 1:
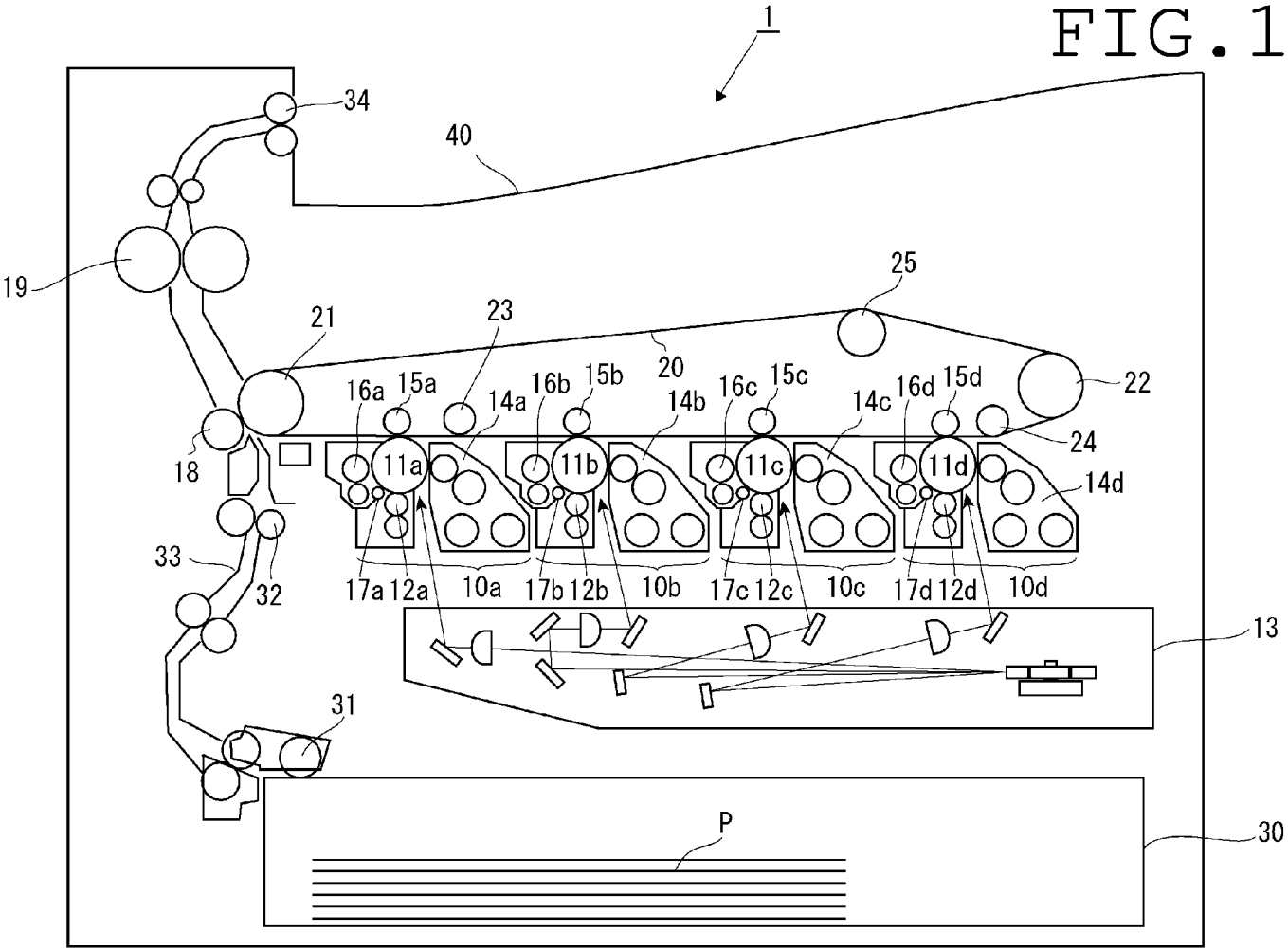
FIG. 1 is an appearance perspective view illustrating a configuration of a first embodiment of an image forming apparatus in accordance with the present disclosure.

An image forming apparatus of the present embodiment is a color printer 1, and with reference to FIG. 1, there are disposed an image forming part 10*a*, which accommodates image data of K (black); an image forming part 10*b*, which accommodates image data of C (cyan); an image forming part 10*c*, which accommodates image data of M (magenta); and an image forming part 10*d*, which accommodates image data of Y (yellow). Being adjacent to the top of the four image forming parts 10*a*, 10*b*, 10*c*, and 10*d*, an intermediate transfer belt 20 is provided. The intermediate transfer belt 20 is stretched over a driving roller 21, a driven roller 22, support rollers 23 and 24, and a tension roller 25.

In the four image forming parts 10*a*, 10*b*, 10*c*, and 10*d*, there are disposed photosensitive drums 11*a*, 11*b*, 11*c*, and 11*d*, respectively, which are for carrying visible images (toner images) of respective colors. Around the photosensitive drums 11*a*, 11*b*, 11*c*, and 11*d*, there are provided electrification apparatuses 12*a*, 12*b*, 12*c*, and 12*d*, which electrify the photosensitive drums 11*a*, 11*b*, 11*c*, and 11*d*, respectively; an exposure unit 13, which exposes image information on the photosensitive drums 11*a*, 11*b*, 11*c*, and 11*d*, respectively; development apparatuses 14*a*, 14*b*, 14*c*, and 14*d*, which form toner images on the photosensitive drums 11*a*, 11*b*, 11*c*, and 11*d*, respectively; primary transfer rollers 15*a*, 15*b*, 15*c*, and 15*d*, which transfer the toner images on the photosensitive drums 11*a*, 11*b*, 11*c*, and 11*d* to the intermediate transfer belt 20, respectively; cleaning apparatuses 16*a*, 16*b*, 16*c*, and 16*d*, which remove the toner remaining on the photosensitive drums 11*a*, 11*b*, 11*c*, and 11*d*, respectively; and static eliminators (erasers) 17*a*, 17*b*, 17*c*, and 17*d*, which irradiate light on the photosensitive drums 11*a*, 11*b*, 11*c*, and 11*d* to eliminate static electricity, respectively.

The toner images that have been formed on the photosensitive drums 11*a*, 11*b*, 11*c*, and 11*d* are sequentially transferred to the intermediate transfer belt 20, which is moved, while being abutted against the photosensitive drums 11*a*, 11*b*, 11*c*, and 11*d*. The toner images, which have been sequentially transferred to the intermediate transfer belt 20, are transferred to a recording paper P with a secondary transfer roller 18 at a time. The recording paper P is stored in a paper cassette 30, which is disposed in the bottom section, and is carried to the secondary transfer roller 18 in a recording paper carrying passage 33 through a feed roller 31 and registration rollers 32. The toner image that has been transferred to the recording paper P is fixed on the recording paper P with a fixing apparatus 19, and the recording paper P that has been provided with a print is discharged onto a top cover 40 by discharge rollers 34 through the recording paper carrying passage 33.

Figure 2:
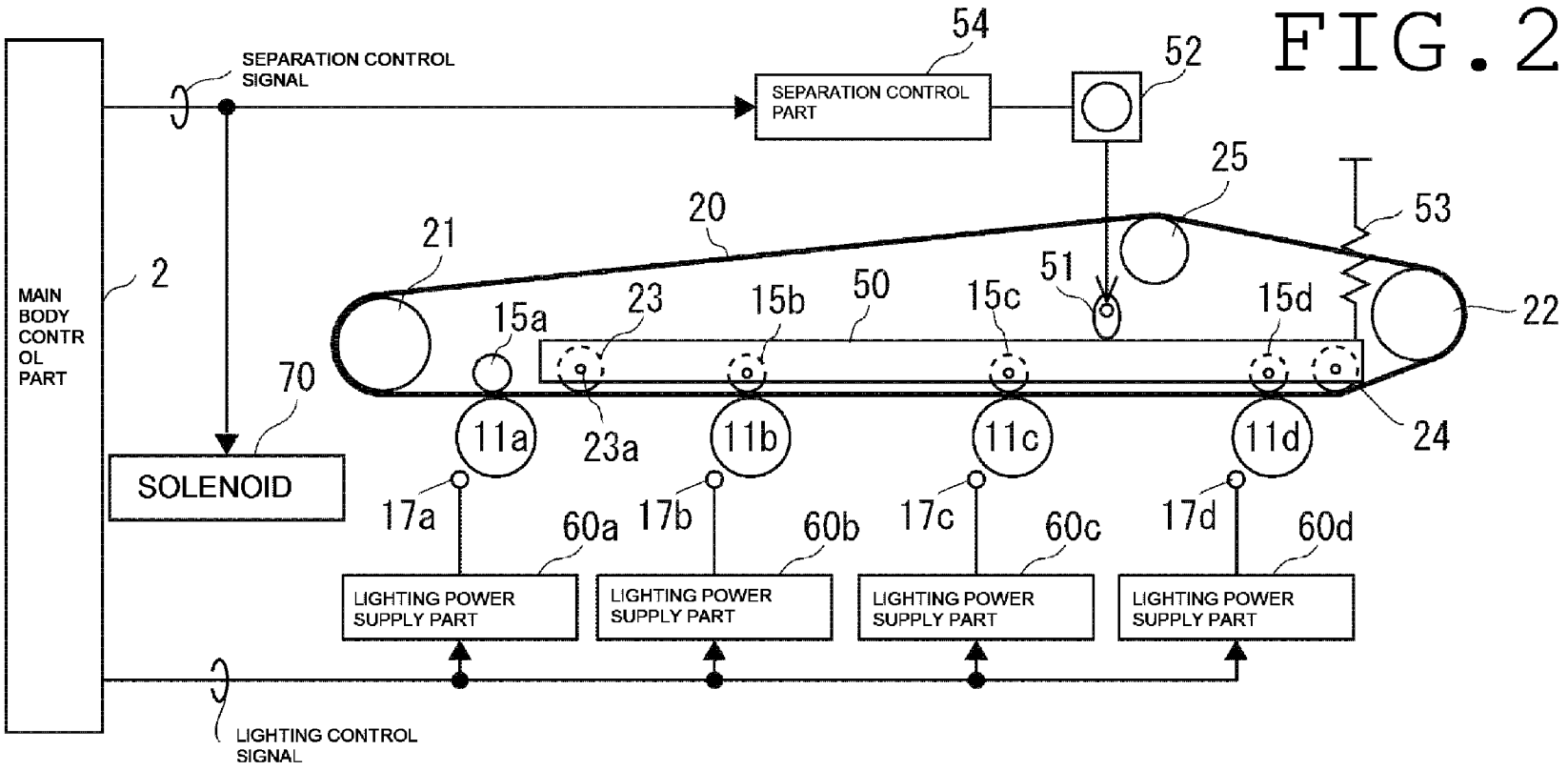
FIG. 2 is a sectional schematic view illustrating an internal configuration of the first embodiment of the image forming apparatus in accordance with the present disclosure.
Figure 3:
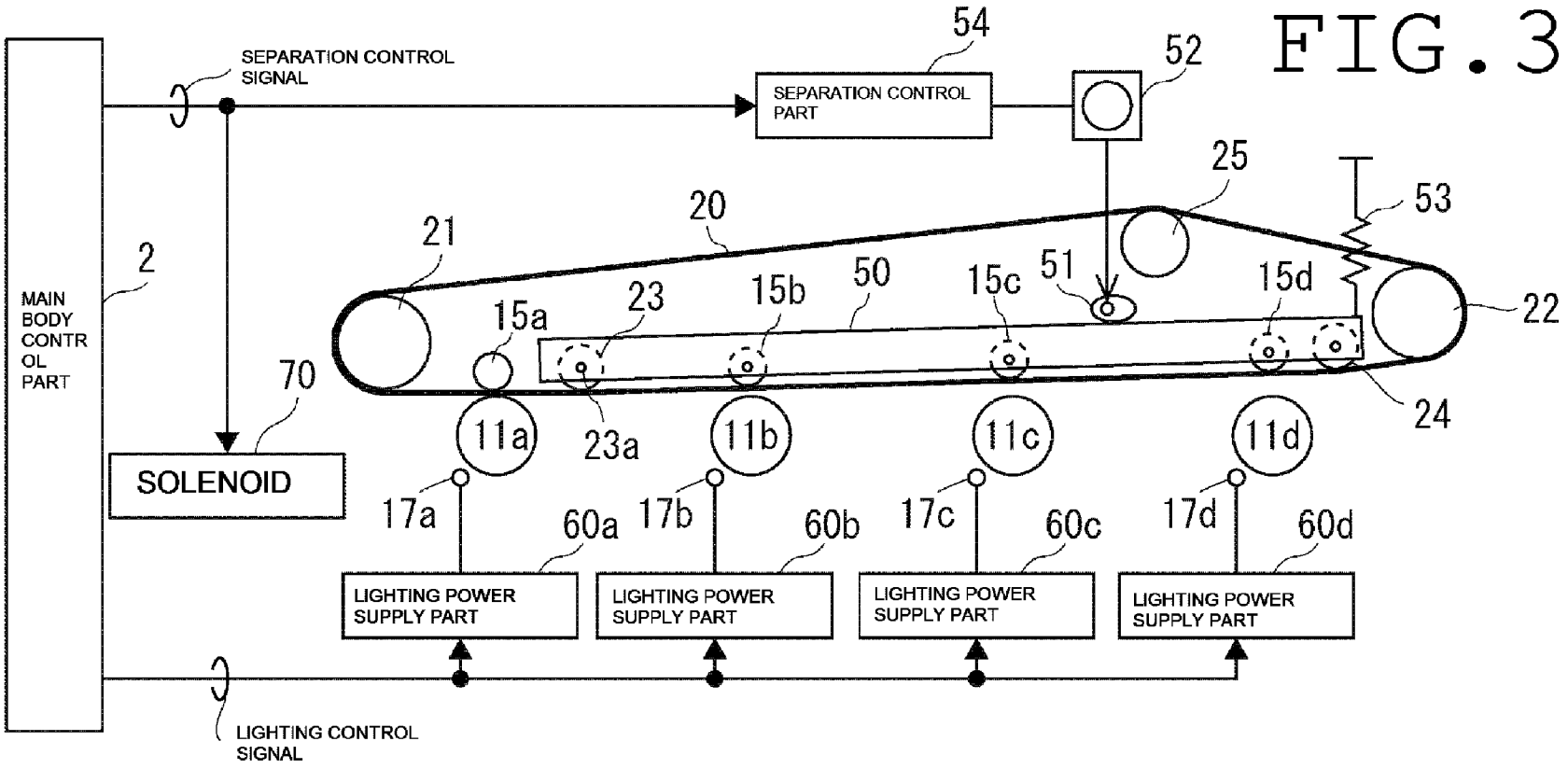
FIG. 3 is a sectional schematic view illustrating an internal configuration of the first embodiment of the image forming apparatus in accordance with the present disclosure.

As shown in FIG. 2 and FIG. 3, the color printer 1 includes a frame 50, an eccentric cam 51, and a cam driving motor 52. The frame 50, the eccentric cam 51, and the cam driving motor 52 constitute a nip separation mechanism, which moves the primary transfer rollers 15*b*, 15*c*, and 15*d* in an up-down direction in the figure, separating the intermediate transfer belt 20 from the color photosensitive drums 11*b*, 11*c*, and 11*d*.

The frame 50 is a frame member that is formed substantially in a U shape in a plan view. The frame 50 rotatably supports the primary transfer rollers 15*b*, 15*c*, and 15*d*, and the support rollers 23 and 24 at both end parts in a width direction. The frame 50 is turnably supported around a turning axis 23*a* of the support roller 23. The support roller 23 is disposed between the primary transfer roller 15*a* of K (black) and the primary transfer roller 15*b* of C (cyan). Further, from the support roller 23 toward the upstream side of the moving direction of the intermediate transfer belt 20, the primary transfer roller 15*b* of C (cyan), the primary transfer roller 15*c* of M (magenta), the primary transfer roller 15*d* of Y (yellow), and the support roller 24 are disposed in this order. Therefore, by turning the frame 50 around the support roller 23, the frame 50 can be moved to an abutting position shown in FIG. 2, and to a separation position shown in FIG. 3, respectively. In the abutting position shown in FIG. 2, the primary transfer roller 15*b* of C (cyan), the primary transfer roller 15*c* of M (magenta), and the primary transfer roller 15*d* of Y (yellow) are abutted against the photosensitive drums 11*b*, 11*c*, and 11*d* through the intermediate transfer belt 20, respectively, to form a primary transfer nip. In the separation position shown in FIG. 3, the primary transfer roller 15*b* of C (cyan), the primary transfer roller 15*c* of M (magenta), and the primary transfer roller 15*d* of Y (yellow) are separated from the photosensitive drums 11*b*, 11*c*, and 11*d*, respectively, the intermediate transfer belt 20 being separated from the photosensitive drums 11*b*, 11*c*, and 11*d*.

In addition, the frame 50 is urged in a counterclockwise direction around the turning axis 23*a* of the support roller 23 by an urging member 53, such as a spring, with an eccentric cam 51 being abutted against the upper end part of the frame 50. Thereby, the eccentric cam 51 functions as a member to move the frame 50 to the abutting position or the separation position, respectively, and fix it in the abutting position or the separation position. The eccentric cam 51 is turned clockwise or counterclockwise by a turning force transmitted from the cam driving motor 52. The cam driving motor 52 is an apparatus to transmit a turning force to the eccentric cam 51, the rotation drive thereof being controlled by the separation control part 54. The separation control part 54 is a motor driver, controlling the rotation drive of the cam driving motor 52 on the basis of a separation control signal from a main body control part 2.

The main body control part 2 is an information processing part of a microcomputer, or the like, including a CPU (Central Processing Unit), a ROM (Read Only Memory), a RAM (Random Access Memory), and the like. In the ROM, a control program for performing operation control of the image forming apparatus is stored. The CPU reads out the control program stored in the ROM, and expands the control program in the RAM. Thereby, the respective components (the image forming parts 10*a*, 10*b*, 10*c*, and 10*d*, the exposure unit 13, the fixing apparatus 19, the intermediate transfer belt 20, and the like) are controlled to realize a series of image formation operations.

In the case where full-color printing in four colors is to be performed with the color printer 1, the main body control part 2 outputs a separation control signal (for example, a Hi level signal) to instruct the abutting position to be taken. When a separation control signal to instruct the abutting position to be taken is inputted, the separation control part 54 causes a turning force to be transmitted from the cam driving motor 52 to the eccentric cam 51. Thereby, the eccentric cam 51 is turned such that it takes a first position where the longer-diameter direction of the eccentric cam 51 is substantially orthogonal to the intermediate transfer belt 20. With the eccentric cam 51 being turned to the first position, the frame 50, which is pressed by the eccentric cam 51, is turned clockwise around the turning axis 23*a* of the support roller 23 against the urging force of the urging member 53.

Thereby, as shown in FIG. 2, the intermediate transfer belt 20 is abutted against the photosensitive drums 11*b*, 11*c*, and 11*d*. The primary transfer roller 15*a* of K (black) causes the intermediate transfer belt 20 to be always abutted against the photosensitive drum 11*a*. Therefore, when the intermediate transfer belt 20 is moved to the abutting position, where it is abutted against the photosensitive drums 11*b*, 11*c*, and 11*d*, the intermediate transfer belt 20 is abutted against all of the photosensitive drums 11*a*, 11*b*, 11*c*, and 11*d*. Therefore, by moving the intermediate transfer belt 20 to the abutting position, it is made possible to perform full-color printing in four colors with the color printer 1.

On the other hand, in the case where monochrome printing is to be performed with the color printer 1, the main body control part 2 outputs a separation control signal (for example, a Low level signal) to instruct the separation position to be taken. When a separation control signal to instruct the separation position to be taken is inputted, the separation control part 54 causes a turning force to be transmitted from the cam driving motor 52 to the eccentric cam 51. Thereby, the eccentric cam 51 is turned such that it takes a second position where the shorter-diameter direction of the eccentric cam 51 is substantially orthogonal to the intermediate transfer belt 20. With the eccentric cam 51 being turned to the second position, the frame 50 is turned counterclockwise around the turning axis 23*a* of the support roller 23 by the urging force of the urging member 53.

Thereby, as shown in FIG. 3, the intermediate transfer belt 20 is separated from the plurality of photosensitive drums 11*b*, 11*c*, and 11*d*. Therefore, when the intermediate transfer belt 20 is moved to the separation position, where it is separated from the photosensitive drums 11*b*, 11*c*, and 11*d*, the intermediate transfer belt 20 is abutted against only the photosensitive drum 11*a*. Therefore, by moving the intermediate transfer belt 20 to the separation position, it is made possible to perform monochrome printing with the color printer 1.

Figure 4A:
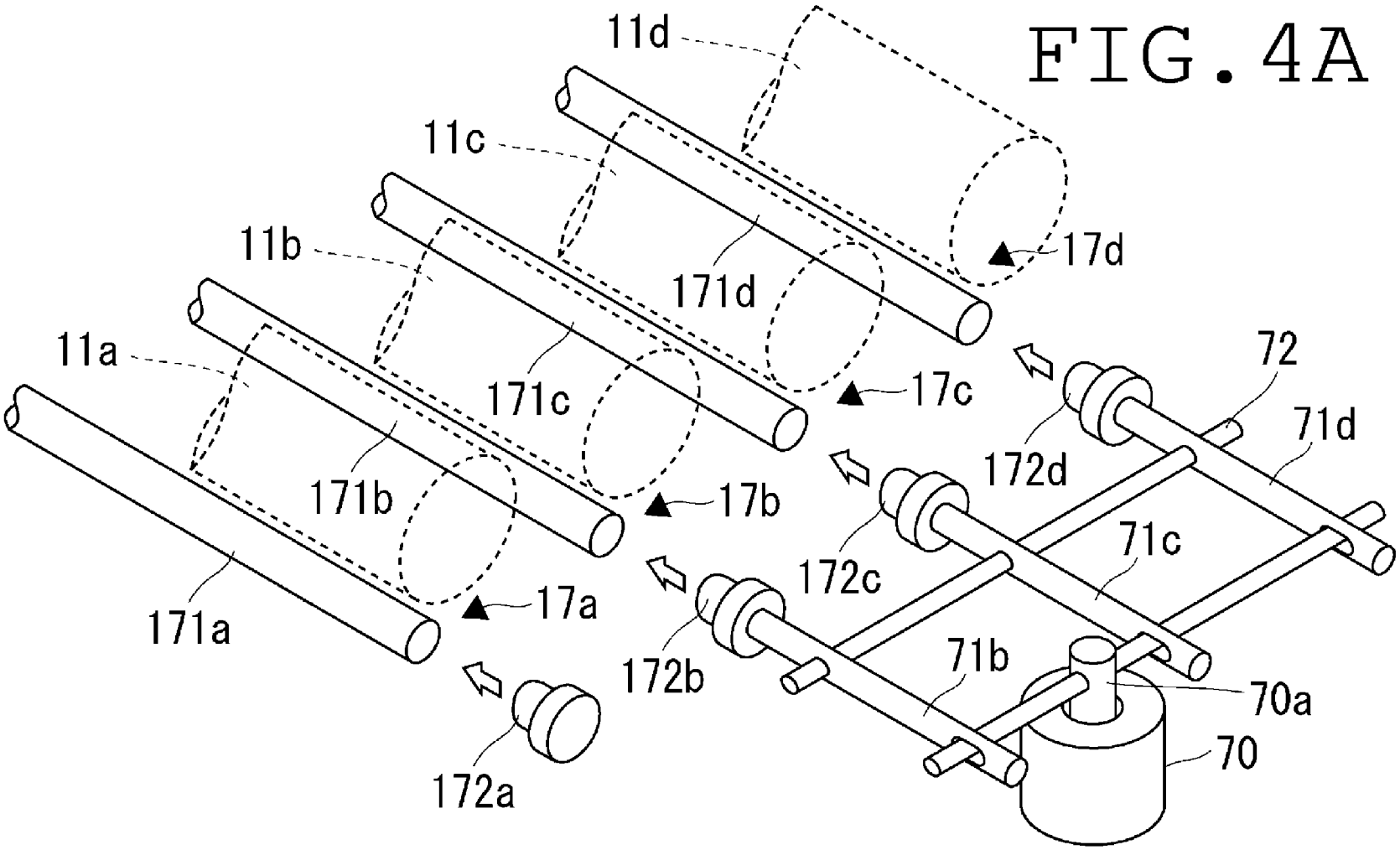
FIG. 4A is a perspective view illustrating an example of configuration of an irradiation location shifting mechanism that shifts the irradiation locations of light sources of static eliminators shown in FIG. 1.

As shown in FIG. 4A, the static eliminators 17*a*, 17*b*, 17*c*, and 17*d* include light guide bodies 171*a*, 171*b*, 171*c*, and 171*d* extending in a rod shape along the photosensitive drums 11*a*, 11*b*, 11*c*, and 11*d*, and LEDs 172*a*, 172*b*, 172*c*, and 172*d*, which are light sources that irradiate light on end faces of the light guide bodies 171*a*, 171*b*, 171*c*, and 171*d*, respectively. The light guide bodies 171*a*, 171*b*, 171*c*, and 171*d* guide light that has been made incident from the end faces, irradiating the light on the photosensitive drums 11*a*, 11*b*, 11*c*, and 11*d*, respectively.

As shown in FIG. 2 and FIG. 3, the LEDs 172*a*, 172*b*, 172*c*, and 172*d* for the static eliminators 17*a*, 17*b*, 17*c*, and 17*d* are lighted up by power distribution from the lighting power supply parts 60*a*, 60*b*, 60*c*, and 60*d*. Further, the lighting power supply parts 60*a*, 60*b*, 60*c*, and 60*d* control power distribution to the static eliminators 17*a*, 17*b*, 17*c*, and 17*d* on the basis of a common lighting control signal from the main body control part 2.

The LED 172*a* for the static eliminator 17*a*, which eliminates static electricity from the photosensitive drum 11*a*, which is for carrying a toner image for a monochrome image, is supported by a supporting member (not shown) that is fixed to the housing, or the like. Therefore, the irradiation location of the light that is emitted from the LED 172*a* is always the end face of the light guide body 171*a*.

As shown in FIG. 4A, the LEDs 172*b*, 172*c*, and 172*d* for the static eliminators 17*b*, 17*c*, and 17*d*, which eliminate static electricity from the photosensitive drums 11*b*, 11*c*, and 11*d*, respectively, which are for carrying toner images for color images, are fixed to one end of the support bars 71*b*, 71*c*, and 71*d*, respectively, which are turnably supported by the turning shaft 72. Further, there is provided a configuration in which the other ends of the support bars 71*b*, 71*c*, and 71*d* are connected to a plunger 70*a* of a solenoid 70, and in accordance with advance/retract of the plunger 70*a*, the support bars 71*b*, 71*c*, and 71*d* are turned.

As shown in FIG. 2 and FIG. 3, the solenoid 70 is controlled to be advanced/retracted by a separation control signal. The solenoid 70 moves the plunger 70*a* to a contracted position with a separation control signal (for example, a Hi level signal) to instruct the abutting position to be taken, and moves the plunger 70*a* to an extended position with a separation control signal (for example, a Low level signal) to instruct the separation position to be taken, respectively.

In a state in which the plunger 70*a* is moved to the contracted position, as shown in FIG. 4A, the irradiation locations of the light emitted from the LEDs 172*b*, 172*c*, and 172*d* are the end faces of the light guide bodies 171*b*, 171*c*, and 171*d*, respectively. Therefore, in the case where full-color printing in four colors is to be performed with the color printer 1, the light emitted from the static eliminator 17*a* is irradiated on the photosensitive drum 11*a*, which is for carrying a toner image for a monochrome image, for making static electricity elimination therefor. In addition, the light that is emitted from the static eliminators 17*b*, 17*c*, and 17*d*, respectively, is irradiated on the photosensitive drums 11*b*, 11*c*, and 11*d*, which are for carrying toner images for color images, for making static electricity elimination therefor.

Figure 4B:
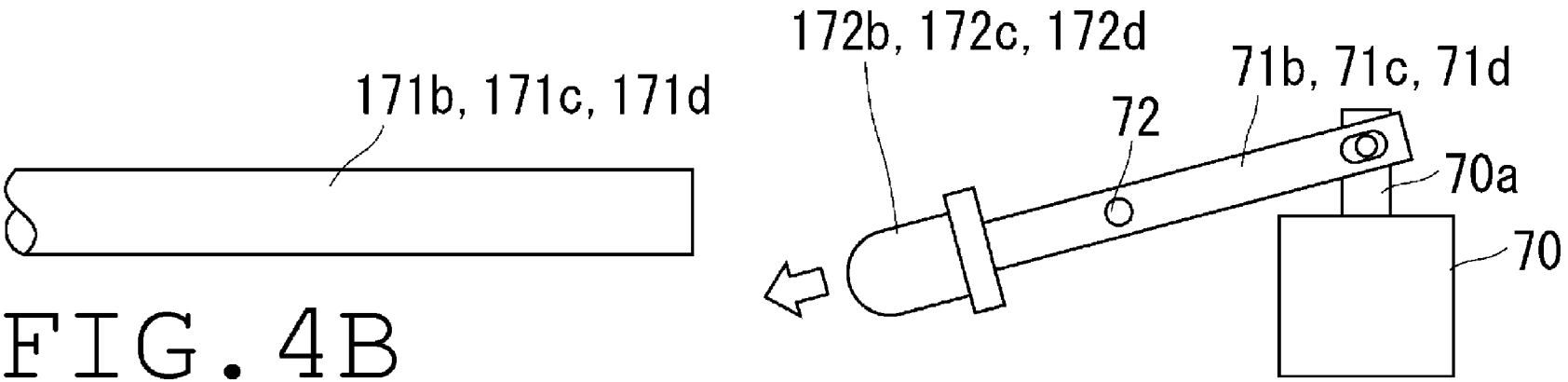
FIG. 4B is a side view illustrating an example of configuration of the irradiation location shifting mechanism that shifts the irradiation locations of the light sources of the static eliminators shown in FIG. 1.

In a state in which the plunger 70*a* is moved in the extended position, as shown in FIG. 4B, with the support bars 71*b*, 71*c*, and 71*d* being turned, the direction of light that is emitted from the LEDs 172*b*, 172*c*, and 172*d*, respectively, is changed. Therefore, the respective irradiation locations of the light that is emitted from the LEDs 172*b*, 172*c*, and 172*d*, are shifted from the end faces of the light guide bodies 171*b*, 171*c*, and 171*d*. Therefore, in the case where monochrome printing is to be performed with the color printer 1, the light that is emitted from the static eliminator 17*a* is irradiated on the photosensitive drum 11*a*, which is for carrying a toner image for a monochrome image, for making static electricity elimination therefor. However, the light that is irradiated from the static eliminators 17*b*, 17*c*, and 17*d*, respectively, is not irradiated on the photosensitive drums 11*b*, 11*c*, and 11*d*, which are for carrying toner images for color images, thereby the static electricity elimination being not made therefor.

Figure 5A:
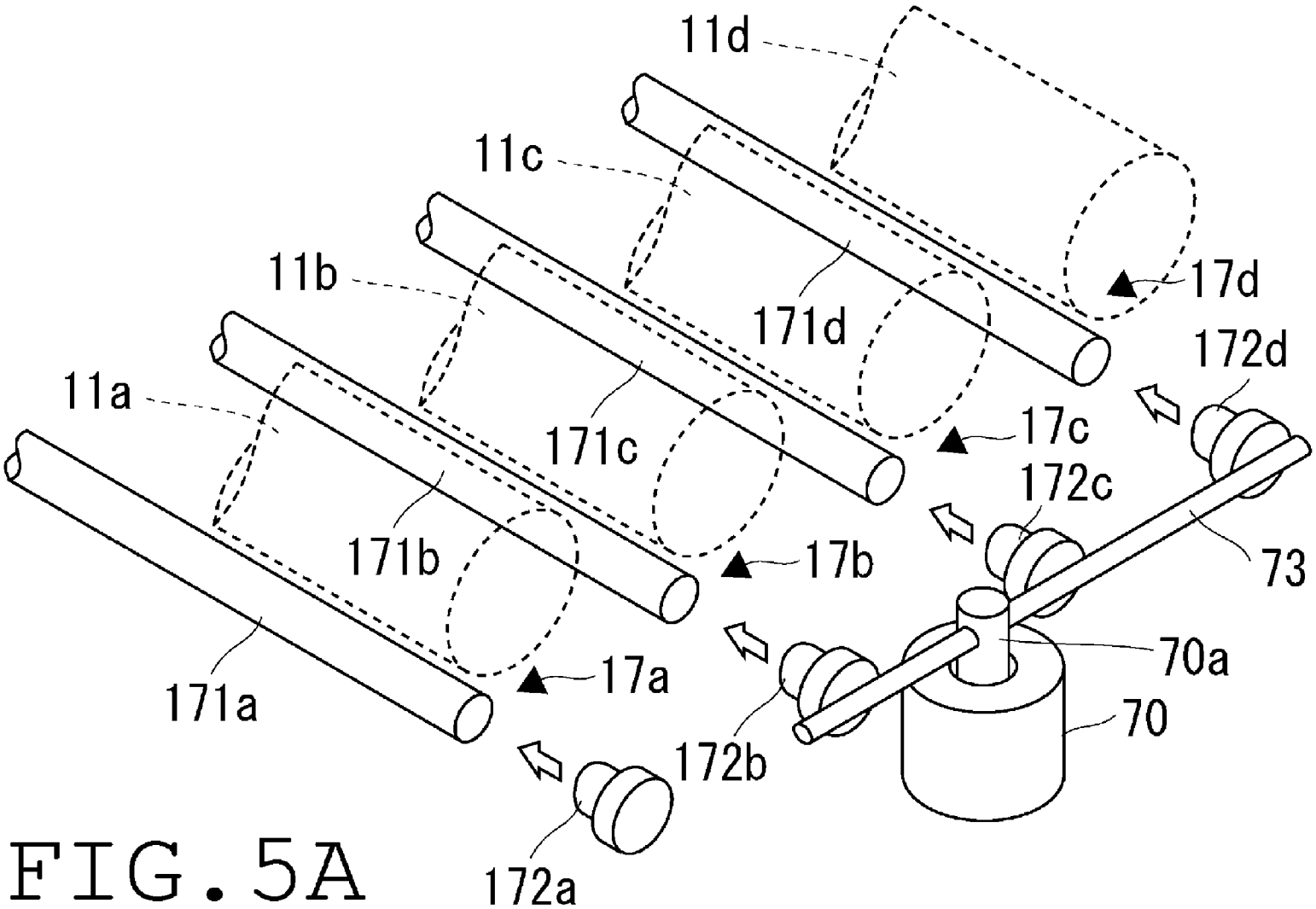
FIG. 5A is a perspective view illustrating another example of configuration of the irradiation location shifting mechanism that shifts the irradiation locations of the light sources of the static eliminators shown in FIG. 1.
Figure 5B:
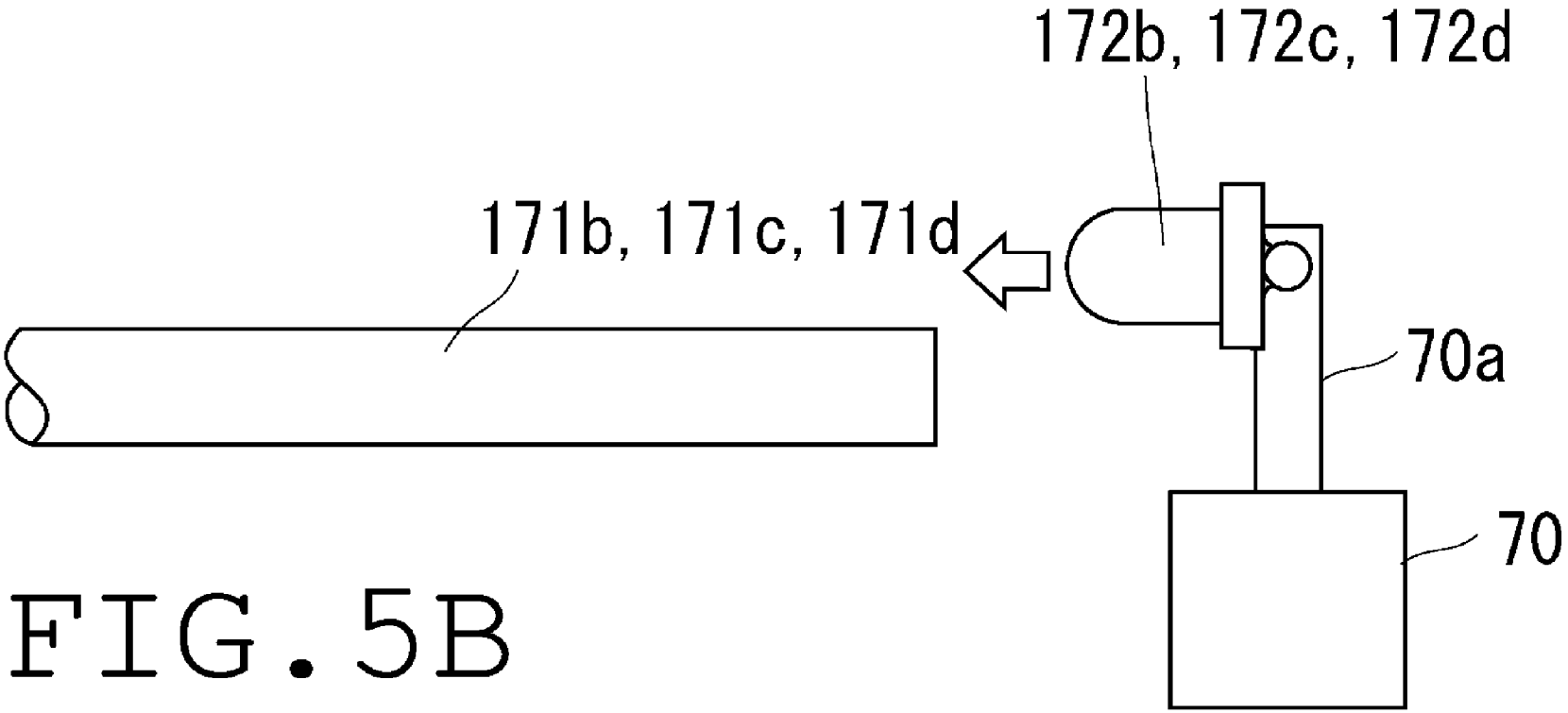
FIG. 5B is a side view illustrating another example of configuration of the irradiation location shifting mechanism that shifts the irradiation locations of the light sources of the static eliminators shown in FIG. 1.

In the present embodiment, there is provided a configuration in which the solenoid 70, which is controlled to be advanced/retracted by a separation control signal, is used to change the direction of light that is emitted from the LEDs 172*b*, 172*c*, and 172*d*, respectively. However, as shown in FIG. 5A and FIG. 5B, the LEDs 172*b*, 172*c*, and 172*d* may be supported with a common support member 73, and the LEDs 172*b*, 172*c*, and 172*d*, which are supported by the support member 73, may be moved to directions intersecting with the axes of the light guide bodies 171*b*, 171*c*, and 171*d*, using the solenoid 70, respectively. Thereby, the respective irradiation location of the light that is emitted from the LEDs 172*b*, 172*c*, and 172*d* can be shifted from the end faces of the light guide bodies 171*b*, 171*c*, and 171*d*. In this case, it is required that the plunger 70*a* be advanced/retracted at a large stroke, as compared to the case where the direction of light is changed, however, the number of component parts, such as the support bars 71*b*, 71*c*, and 71*d*, can be reduced.

In addition, the support member 73 may be shifted interlockingly with the operation of the nip separation mechanism (movement of the frame 50 or turning of the eccentric cam 51), which moves the primary transfer rollers 15*b*, 15*c*, and 15*d*. In this case, the solenoid 70 can be obviated.

Further, there may be provided a light shielding plate which is advanced between the LEDs 172*b*, 172*c*, and 172*d* and the end faces of the light guide bodies 171*b*, 171*c*, and 171*d*, the light shielding plate being advanced/retracted with the operation of the solenoid 70 or the nip separation mechanism. Thereby, the respective irradiation locations of the light that is emitted from the LEDs 172*b*, 172*c*, and 172*d* can be changed. In this case, by advancing the light shielding plate between the LEDs 172*b*, 172*c*, and 172*d* and the end faces of the light guide bodies 171*b*, 171*c*, and 171*d*, the respective irradiation locations of the light that is emitted from the LEDs 172*b*, 172*c*, and 172*d* are changed into locations on the light shielding plate.

As described above, according to the present embodiment, there is provided a color printer 1 (an image forming apparatus) including an image forming part 10*a* (a monochrome image forming part) that forms a toner image for a monochrome image on a photosensitive drum 11*a* (a monochrome photosensitive drum); image forming parts 10*b*, 10*c*, and 10*d* (color image forming parts) that form toner images for color images on photosensitive drums 11*b*, 11*c*, and 11*d* (color photosensitive drums), respectively; and an intermediate transfer belt 20 that once carries the toner image to be transferred to a recording paper, the color printer 1, at the time of monochrome printing, transferring only the toner image that has been formed on the photosensitive drum 11*a*, to the intermediate transfer belt 20, and at the time of color printing, sequentially transferring the toner image that has been formed on the photosensitive drum 11*a*, and the toner images that have been formed on the photosensitive drums 11*b*, 11*c*, and 11*d*, respectively, to the intermediate transfer belt 20, the color printer 1 having:

a main body control part 2 that controls image formation with image forming parts 10*a*, 10*b*, 10*c*, and 10*d*, a nip separation mechanism (a frame 50, an eccentric cam 51, and a cam driving motor 52) that separates the intermediate transfer belt 20 from the photosensitive drums 11*b*, 11*c*, and 11*d*, a separation control part 54 that drives the nip separation mechanism on the basis of a separation control signal that is inputted from the main body control part 2, a static eliminator 17*a* that is comprised of a light guide body 171*a* that extends in a rod shape along the photosensitive drum 11*a*, and an LED 172*a* (a monochrome light source) that irradiates light on an end face of the light guide body 171*a*, static eliminators 17*b*, 17*c*, and 17*d* that are comprised of light guide bodies 171*b*, 171*c*, and 171*d* that extend in a rod shape along the photosensitive drums 11*b*, 11*c*, and 11*d*, and LEDs 172*b*, 172*c*, and 172*d* (color light sources) that irradiate light on end faces of the light guide bodies 171*b*, 171*c*, and 171*d*, and an irradiation location shifting means (a solenoid 70, support bars 71*b*, 71*c*, and 71*d*, and a turning shaft 72) that shifts the irradiation locations of the light that is emitted from the LEDs 172*b*, 172*c*, and 172*d*, from the end faces of the light guide bodies 171*b*, 171*c*, and 171*d*, in a state of the intermediate transfer belt 20 being separated from the photosensitive drums 11*b*, 11*c*, and 11*d*.

With this configuration, at the time of monochrome printing, even if the color static eliminators 17*b*, 17*c*, and 17*d* are lighted up, light will not be irradiated on the photosensitive drums 11*b*, 11*c*, and 11*d* of yellow, magenta, and cyan. Therefore, lighting control of the static eliminator 17*a*, which eliminates static electricity from the photosensitive drum 11*a* of black, and lighting control of the static eliminators 17*b*, 17*c*, and 17*d*, which eliminate static electricity from the photosensitive drums 11*b*, 11*c*, and 11*d* of yellow, magenta, and cyan, can be performed with a commonalized lighting control signal. Therefore, the static eliminators 17*a*, 17*b*, 17*c*, and 17*d* can be controlled with a single port of the CPU in the main body control part 2.

Further, according to the present embodiment, the irradiation location shifting means (the solenoid 70) shifts the irradiation locations of the light that is emitted from the LEDs 172*b*, 172*c*, and 172*d* from the end faces of the light guide bodies 171*b*, 171*c*, and 171*d* on the basis of a lighting control signal that is inputted from the main body control part 2.

Further, according to the present embodiment, the irradiation location shifting means shifts the irradiation locations of the light that is emitted from the LEDs 172*b*, 172*c*, and 172*d*, from the end faces of the light guide bodies 171*b*, 171*c*, and 171*d*, being interlocked with the operation of the nip separation mechanism.

Next, a second embodiment of the present disclosure will be specifically explained with reference to the drawings.

Figure 6:
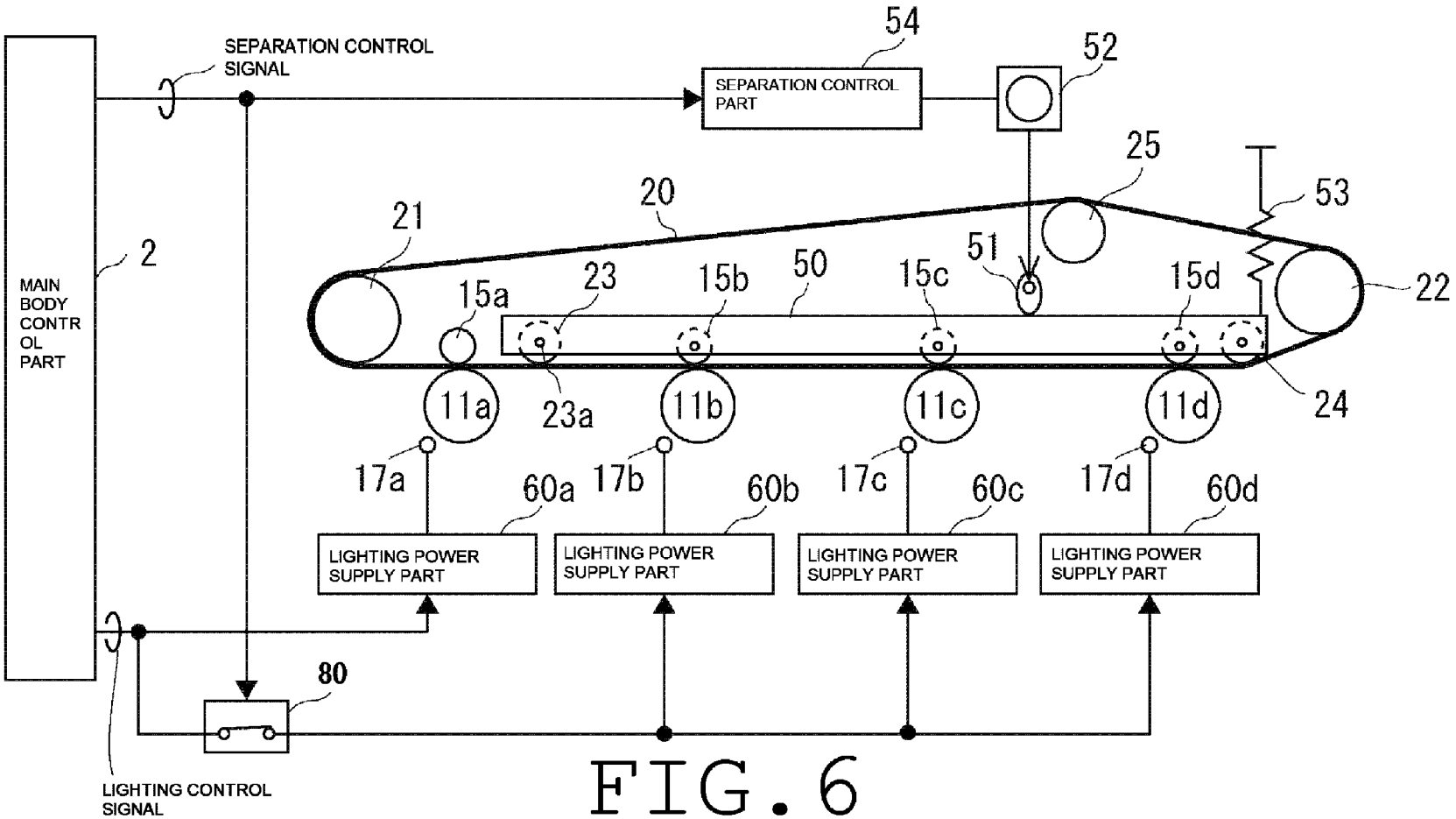
FIG. 6 is a sectional schematic view illustrating an internal configuration of a second embodiment of the image forming apparatus in accordance with the present disclosure.
Figure 7:
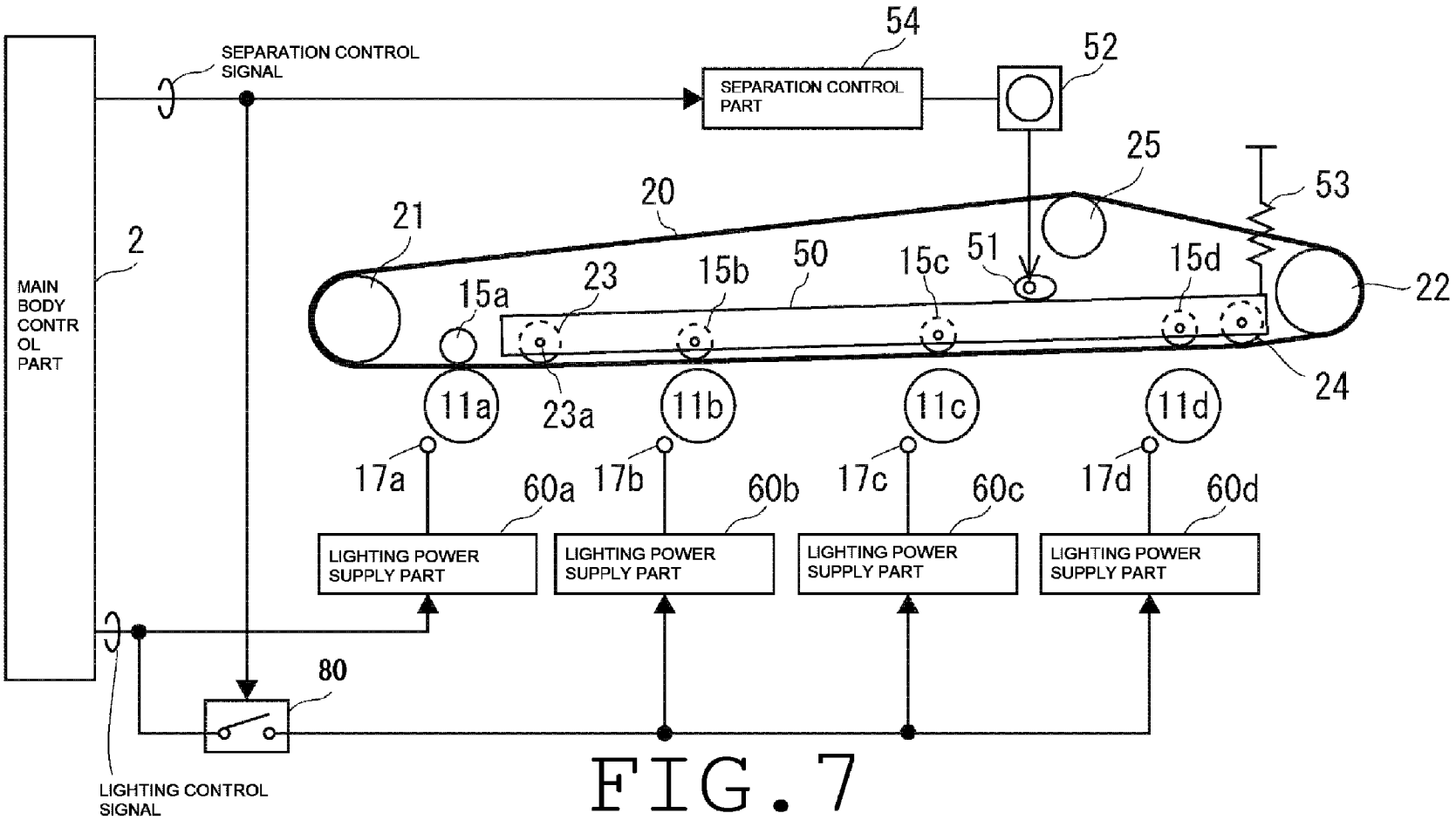
FIG. 7 is a sectional schematic view illustrating an internal configuration of the second embodiment of the image forming apparatus in accordance with the present disclosure.

With the present embodiment, the light sources of the light that is irradiated on the photosensitive drums 11*a*, 11*b*, 11*c*, and 11*d* by the static eliminators 17*a*, 17*b*, 17*c*, and 17*d*, respectively, are constituted by lamps or LEDs that are lighted up by power distribution from the lighting power supply parts 60*a*, 60*b*, 60*c*, and 60*d*. The lighting power supply parts 60*a*, 60*b*, 60*c*, and 60*d* control the power distribution to the static eliminators 17*a*, 17*b*, 17*c*, and 17*d* on the basis of a common lighting control signal from the main body control part 2. The lighting control signal that is outputted from the main body control part 2 is directly inputted to the lighting power supply part 60*a*, and is inputted to the lighting power supply parts 60*b*, 60*c*, and 60*d* through the switch 80 shown in FIGS. 6 and 7.

The switch 80 is controlled to be turned ON/OFF by a separation control signal from the main body control part 2, being controlled to be turned ON by a separation control signal (for example, a Hi level signal) that instructs an abutting position to be taken, while being controlled to be turned OFF by a separation control signal (for example, a Low level signal) that instructs a separation position to be taken. Therefore, in full-color printing in four colors, the switch 80 is controlled to be turned ON, the lighting control signal from the main body control part 2 is inputted to the lighting power supply parts 60*a*, 60*b*, 60*c*, and 60*d*, respectively, the main body control part 2 controlling the lighting of the static eliminators 17*a*, 17*b*, 17*c*, and 17*d*. Contrarily to this, in monochrome printing, the switch 80 is controlled to be turned OFF, and thus the lighting control signal from the main body control part 2 is inputted only to the lighting power supply part 60*a*, the main body control part 2 controlling only the lighting of the static eliminator 17*a*.

In the present embodiment, the switch 80 has been configured such that it is controlled to be turned ON/OFF from a separation control signal from the main body control part 2. However, the switch 80 may be constituted by a physical switch that is turned ON/OFF with the operation (movement of the frame 50 or turning of the eccentric cam 51) of the nip separation mechanism, which moves the primary transfer rollers 15*b*, 15*c*, and 15*d*. In addition, in the present embodiment, there has been provided a configuration in which the intermediate transfer belt 20 is moved, however, there may be provided a configuration in which the image forming parts 10*b*, 10*c*, and 10*d* are moved in a direction to be separated from the intermediate transfer belt 20.

As described above, according to the present embodiment, there is provided a color printer 1 (an image forming apparatus) including an image forming part 10*a* (a monochrome image forming part) that forms a toner image for a monochrome image on a photosensitive drum 11*a* (a monochrome photosensitive drum); image forming parts 10*b*, 10*c*, and 10*d* (color image forming parts) that form toner images for color images on photosensitive drums 11*b*, 11*c*, and 11*d* (color photosensitive drums), respectively; and an intermediate transfer belt 20 that once carries the toner image to be transferred to a recording paper, the color printer 1, at the time of monochrome printing, transferring only the toner image that has been formed on the photosensitive drum 11*a*, to the intermediate transfer belt 20, and at the time of color printing, sequentially transferring the toner image that has been formed on the photosensitive drum 11*a*, and the toner images that have been formed on the photosensitive drums 11*b*, 11*c*, and 11*d*, respectively, to the intermediate transfer belt 20, the color printer 1 having;

a main body control part 2 that controls image formation with image forming parts 10*a*, 10*b*, 10*c*, and 10*d*, a nip separation mechanism (a frame 50, an eccentric cam 51, and a cam driving motor 52) that separates the intermediate transfer belt 20 from the photosensitive drums 11*b*, 11*c*, and 11*d*, a separation control part 54 that drives the nip separation mechanism on the basis of a separation control signal that is inputted from the main body control part 2, a static eliminator 17*a* (a monochrome static eliminator) that eliminates static electricity from the photosensitive drum 11*a*, static eliminators 17*b*, 17*c*, and 17*d* (color static eliminators) that eliminate static electricity from the photosensitive drums 11*b*, 11*c*, and 11*d*, respectively, a switch 80 that is turned ON in a state of the intermediate transfer belt 20 being abutted against the photosensitive drums 11*b*, 11*c*, and 11*d*, and is turned OFF in a state of the intermediate transfer belt 20 being separated from the photosensitive drums 11*b*, 11*c*, and 11*d*, a lighting power supply part 60*a* (a monochrome lighting power supply part) that makes power distribution to the static eliminator 17*a* to light it up on the basis of a lighting control signal that is inputted from the main body control part 2, and lighting power supply parts 60*b*, 60*c*, and 60*d* (color lighting power supply parts) that make power distribution to the static eliminators 17*b*, 17*c*, and 17*d* to light them up, respectively, on the basis of a lighting control signal that is inputted from the main body control part 2 through the switch 80.

With this configuration, lighting control of the static eliminator 17*a*, which eliminates static electricity from the photosensitive drum 11*a* of black, and lighting control of the static eliminators 17*b*, 17*c*, and 17*d*, which eliminate static electricity from the photosensitive drums 11*b*, 11*c*, and 11*d* of yellow, magenta, and cyan, can be performed with a commonalized lighting control signal. Therefore, the static eliminators 17*a*, 17*b*, 17*c*, and 17*d* can be controlled with a single port of the CPU in the main body control part 2.

Further, according to the present embodiment, the switch 80 is controlled to be turned ON/OFF on the basis of a separation control signal.

Further, according to the present embodiment, the switch 80 may be a physical switch that is turned ON/OFF with the operation of the nip separation mechanism.

The present disclosure is not limited to the above respective embodiments, and it is obvious that the respective embodiments can be appropriately modified within the scope of the technical concept of the present disclosure. In addition, the number, location, geometry, and the like, of the above components are not limited to those mentioned in the above embodiments, and may be adapted to be a number, location, geometry, and the like, that are appropriate for embodying the present disclosure. In the respective figures, the same component is provided with the same symbol.

What is claimed is:

1. An image forming apparatus comprising a monochrome image forming part that forms a toner image for a monochrome image on a monochrome photosensitive drum; color image forming parts that form toner images for color images on color photosensitive drums; and an intermediate transfer belt that once carries the toner image to be transferred to a recording paper, the image forming apparatus, at the time of monochrome printing, transferring only the toner image that has been formed on the monochrome photosensitive drum, to the intermediate transfer belt, and at the time of color printing, sequentially transferring the toner image that has been formed on the monochrome photosensitive drum, and the toner images that have been formed on the color photosensitive drums, to the intermediate transfer belt, the image forming apparatus including:

a main body control part that controls image formation with the monochrome image forming part and the color image forming parts, a nip separation mechanism that separates the intermediate transfer belt from the color photosensitive drums, a separation control part that drives the nip separation mechanism on the basis of a separation control signal that is inputted from the main body control part, a monochrome static eliminator that is comprised of a monochrome light guide body that extends in a rod shape along the monochrome photosensitive drum, and a monochrome light source that irradiates light on an end face of the monochrome light guide body, color static eliminators that are comprised of color light guide bodies that extend in a rod shape along the color photosensitive drums, and color light sources that irradiate light on end faces of the color light guide bodies, and an irradiation location shifting mechanism that shifts the irradiation locations of the light that is emitted from the color light sources, from the end faces of the color light guide bodies, in a state of the intermediate transfer belt being separated from the color photosensitive drums.

2. The image forming apparatus according to claim 1, wherein the irradiation location shifting mechanism shifts the irradiation locations of the light that is emitted from the color light sources, from the end faces of the color light guide bodies on the basis of a lighting control signal that is inputted from the main body control part.

3. The image forming apparatus according to claim 1, wherein the irradiation location shifting mechanism shifts the irradiation locations of the light that is emitted from the color light sources, from the end faces of the color light guide bodies, being interlocked with the operation of the nip separation mechanism.

4. An image forming apparatus comprising a monochrome image forming part that forms a toner image for a monochrome image on a monochrome photosensitive drum; color image forming parts that form toner images for color images on color photosensitive drums; and an intermediate transfer belt that once carries the toner image to be transferred to a recording paper, the image forming apparatus, at the time of monochrome printing, transferring only the toner image that has been formed on the monochrome photosensitive drum, to the intermediate transfer belt, and at the time of color printing, sequentially transferring the toner image that has been formed on the monochrome photosensitive drum, and the toner images that have been formed on the color photosensitive drums, to the intermediate transfer belt, the image forming apparatus including:

a main body control part that controls image formation with the monochrome image forming part and the color image forming parts, a nip separation mechanism that separates the intermediate transfer belt from the color photosensitive drums, a separation control part that drives the nip separation mechanism so that the intermediate transfer belt is abutted against the color photosensitive drums when a separation control signal that is inputted from the main body control part to instruct the abutting position to be taken is inputted, and that the intermediate transfer belt is separated from the color photosensitive drums when the separation control signal instruct the separation position to be taken is inputted, a monochrome static eliminator that eliminates static electricity from the monochrome photosensitive drum, a color static eliminator that eliminates static electricity from the color photosensitive drums, a switch that is turned ON when the separation control signal to instruct the abutting position to be taken is inputted, and that is turned OFF when the separation control signal to instruct the separation position to be taken is inputted, a monochrome lighting power supply part that makes power distribution to the monochrome static eliminator to light it up on the basis of a lighting control signal that is inputted from a single port of the main body control part, and color lighting power supply parts that makes power distribution to the color static eliminators to light them up on the basis of the lighting control signal that is inputted from the single port of the main body control part through the switch.

5. The image forming apparatus according to claim 4, wherein the switch is controlled to be turned ON/OFF on the basis of the separation control signal.

6. The image forming apparatus according to claim 4, wherein the switch is a physical switch that is turned ON/OFF with the operation of the nip separation mechanism.

* * * * *